US008573999B2

(12) United States Patent
Feldner et al.

(10) Patent No.: US 8,573,999 B2
(45) Date of Patent: Nov. 5, 2013

(54) PLUG-IN CONNECTOR AS RECEPTACLE FOR A MULTI-WIRE CABLE

(75) Inventors: Ralf Feldner, Detmold (DE); Thomas Fuhrer, Blomberg (DE)

(73) Assignee: Phoenix Contact GmbH, Blomberg (DE)

( * ) Notice: Subject to any disclaimer, the term of this patent is extended or adjusted under 35 U.S.C. 154(b) by 125 days.

(21) Appl. No.: 13/081,971

(22) Filed: Apr. 7, 2011

(65) Prior Publication Data

US 2012/0088395 A1 Apr. 12, 2012

(30) Foreign Application Priority Data

Apr. 8, 2010 (DE) ..... 10 2010 014 295

(51) Int. Cl.
*H01R 4/24* (2006.01)

(52) U.S. Cl.
USPC ..... 439/409; 439/410

(58) Field of Classification Search
USPC ..... 439/409, 410, 417, 404, 607, 941
See application file for complete search history.

(56) References Cited

U.S. PATENT DOCUMENTS

| | | | | |
|---|---|---|---|---|
| 5,762,518 | A * | 6/1998 | Tanigawa et al. | 439/409 |
| 6,193,526 | B1 * | 2/2001 | Milner et al. | 439/76.1 |
| 6,887,094 | B2 * | 5/2005 | Boeck et al. | 439/417 |
| 7,134,909 | B2 * | 11/2006 | Baba et al. | 439/557 |
| 7,249,979 | B2 | 7/2007 | Gerber et al. | |
| 7,540,760 | B1 * | 6/2009 | Chen | 439/409 |
| 7,540,789 | B2 | 6/2009 | Gerber et al. | |
| 7,572,140 | B2 | 8/2009 | Szelag et al. | |
| 7,618,262 | B2 * | 11/2009 | Fogg et al. | 439/65 |
| 7,727,025 | B2 * | 6/2010 | Fogg et al. | 439/660 |
| 8,192,224 | B2 * | 6/2012 | Schmidt et al. | 439/409 |
| 8,313,346 | B2 * | 11/2012 | Sparrowhawk et al. | 439/607.05 |
| 2006/0183359 | A1 | 8/2006 | Gerber et al. | |
| 2008/0050965 | A1 | 2/2008 | Szelag et al. | |
| 2008/0057793 | A1 | 3/2008 | Gerber et al. | |
| 2008/0160837 | A1 | 7/2008 | Siemon et al. | |
| 2009/0142968 | A1 | 6/2009 | Goodrich et al. | |

FOREIGN PATENT DOCUMENTS

| | | | |
|---|---|---|---|
| CN | 1945900 | A | 4/2007 |
| CN | 101145653 | A | 3/2008 |
| DE | 102006039799 | B3 | 11/2007 |
| EP | 1693934 | A1 | 8/2006 |
| JP | 2006228735 | A | 8/2006 |
| WO | 2008071917 | A1 | 6/2008 |
| WO | 2010030563 | A1 | 3/2010 |

* cited by examiner

*Primary Examiner* — Xuong Chung Trans
(74) *Attorney, Agent, or Firm* — KPPB LLP

(57) ABSTRACT

The invention pertains to a plug-connector for insertion of a multi-wire cable, wherein the wires are attached with the clamping-cutting technique. The plug-in connector exhibits a substrate and a plurality of clamping-cutting devices configured on the substrate and suitable for the insertion of wires. A first subset of the plurality of clamping-cutting devices is located on top of the substrate, while a second subset of the plurality of clamping-cutting devices is located at the bottom of the substrate. The plug-in connector furthermore exhibits wiring flaps suitable for the hinged insertion of the wires into the clamping-cutting devices.

9 Claims, 5 Drawing Sheets

PLUG-IN CONNECTOR AS RECEPTACLE FOR A MULTI-WIRE CABLE

RELATED APPLICATIONS

This application claims priority to German Application No. 102010014295.6 filed Apr. 8, 2010, the disclosure of which is incorporated herein by reference.

FIELD OF THE INVENTION

The invention pertains to a plug-in connector able to receive a multi-wire cable.

BACKGROUND OF THE INVENTION

Known from the state of the art are different RJ45 plugs for different categories of transmission. Standard Cat5e does not require mandatory shielding of the individual conductors of the wire pairs. When these plugs are shielded, they are usually shielded by a piece of metal attached to the outside.

The new Cat6A transmission standard has significantly stricter requirements for the shielding as well as the routing of the wires inside the plug.

This requires great care when attaching a cable to the plug.

There is the additional requirement that the plugs should be easy to assemble in the field, i.e. they should be easy to handle.

Simultaneous fulfillment of the requirement of reliable connections meeting the requirements of Cat6A as well as easy handling in the field were not given in the state of the art known to the applicant.

The applicant has realized that one significant measure to meet the requirements of Cat6A is the individual shielding of wires of a wire pair, while minimizing the near-end crosstalk at the connection points as well.

SUMMARY OF THE INVENTION

The invention solves the aforementioned problem by providing a plug-in connector for a multi-wire cable, wherein the wires are attached using the clamping-cutting technique. The plug-in connector exhibits a substrate and a plurality of clamping-cutting devices.

The clamping-cutting devices are configured on the substrate and suitable for the insertion of one wire each.

A first subset of the plurality of clamping-cutting devices is located on top of the substrate, and a second subset of the plurality of clamping-cutting devices is located at the bottom of the substrate.

The plug-in connector furthermore exhibits wiring flaps appropriate for the hinged insertion of wires into clamping-cutting devices.

In another embodiment, the number of the first subset of clamping-cutting devices is identical to the number of the second subset of clamping-cutting devices.

In another embodiment, the wiring flap exhibits insulating inserts suitable for the hinged insertion of wires into the respective clamping-cutting devices.

In yet another embodiment, the wiring flaps exhibit in their closed state at least one electrically conductive bridge for the high-frequency separation of the wires.

In yet another embodiment, the plug-in connector exhibits a base body to which the wiring flaps are hinged, wherein the hinge joint of the wiring flaps is located at the entry side of the wires.

In yet another embodiment, wires, which are part of a pair of wires, are exactly assigned to one subset.

In yet another embodiment, the wiring flaps feature a conductive material.

In yet another embodiment, the clamping-cutting devices of the first subset are configured offset to each other, so that wires, which are part of a pair of wires, are connected at a spatial distance from each other.

In yet another embodiment, the plug-in connector is an RJ45 plug.

In yet another embodiment, the plug is suitable for Cat6A.

BRIEF DESCRIPTION OF THE DRAWINGS

Using the following drawings, the invention will be explained in greater detail.

| REFERENCE NUMBER LIST FOR DRAWINGS | |
|---|---|
| 1. | Plug-in connector |
| 2. | Substrate |
| 3a to 3h | Clamping-cutting device |
| 4a, 4b | Wiring flaps |
| 5a to 5d | Inserts |
| 6. | Electrically conductive bridge |
| 7. | Base body |

DETAILED DESCRIPTION OF THE INVENTION

Figure 1:
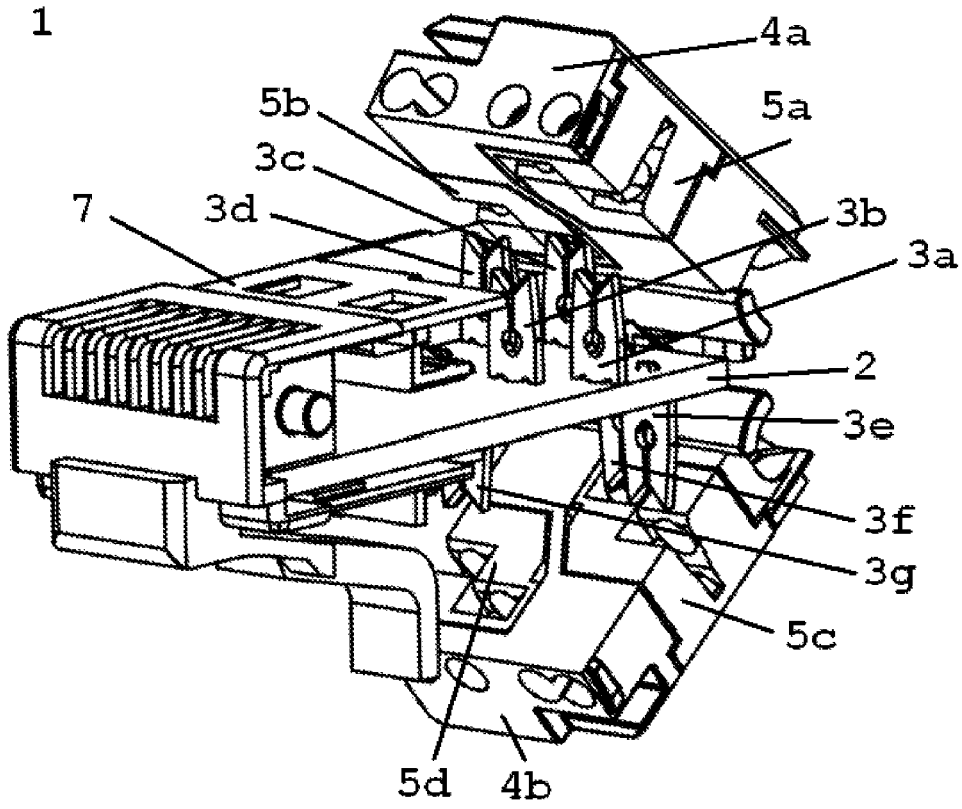
FIG. 1 shows a schematic view as an illustrative presentation of the invention.

FIG. 1 shows a schematic drawing as an illustrative presentation of the invention.

The plug-in connector 1 is suitable as a receptacle of a multi-wire cable. The wires are attached using the clamping-cutting technique with a plurality of clamping-cutting devices 3*a* to 3*h*. The clamping-cutting devices 3*a* to 3*h* are configured on a substrate 2.

The first subset of the plurality of clamping-cutting devices 3*a*, 3*b*, 3*c*, 3*d* is configured on top of the substrate 2, and a second subset of the plurality of clamping-cutting devices 3*e*, 3*f*, 3*g*, 3*h* is configured at the bottom of the substrate.

The plug-in connector 1 furthermore exhibits wiring flaps 4*a* and 4*b*, which are suitable for the hinged insertion of wires into clamping-cutting devices 3*a* to 3*h*. For this purpose, the wiring flaps 4*a*, 4*b* exhibit bore holes suitable to receive the wires of a cable.

In the shown embodiment, the quantity of the first subset of the plurality of clamping-cutting devices 3*a*, 3*b*, 3*c*, 3*d* is identical to the quantity of the second subset of the plurality of clamping-cutting devices 3*e*, 3*f*, 3*g*, 3*h*.

The invention is, however, not limited to the same quantity.

Furthermore preferred is an identical design of the wiring flaps 4*a* and 4*b*, so that only one manufacturing tool is required.

Furthermore, the embodiment of the invention may exhibit in the wiring flaps 4*a*, 4*b* one or more inserts 5*a*, 5*b*, 5*c*, 5*d* (as shown), which are suitable for the hinged insertion of wires into clamping-cutting devices 3*a* to 3*h*.

Inserts 5*a*, 5*b*, 5*c*, 5*d* also exhibit appropriate boreholes suitable for insertion of the wire of a cable. These holes are similar to those in the wiring flaps 4*a*. 4*b*. See FIG. 5.

The inserts are preferably made of an insulating material like a plastic material using injection-molding technology. Other suitable materials may be of a ceramic nature.

As a result, short circuits to the wires in the area of the clamping-cutting devices 3*a* to 3*h* can be reliably prevented, when metallic wiring flaps 4*a*, 4*b* are being used.

In a further preferred embodiment, inserts 5*a*, 5*b*, 5*c*, 5*d* are of an identical design, so that only one manufacturing tool is required.

In a preferred embodiment, the wiring flaps 4*a*, 4*b* exhibit in the closed state at least one electrically conductive bridge 6 for high-frequency separation of the wires. In yet another embodiment, wiring flaps 4*a*, 4*b* themselves are made of an electrically conductive material and therefore create themselves an electrically conductive bridge 6.

Figure 2:
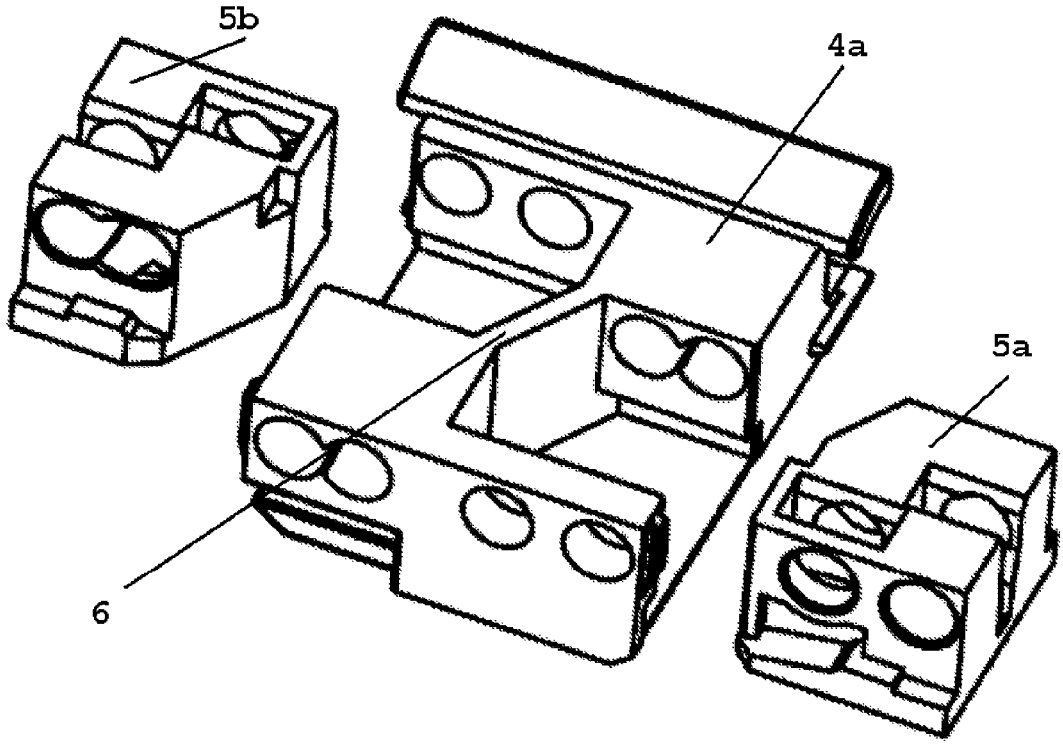
FIG. 2 shows a wiring flap and two associated inserts in the disassembled state.
Figure 3:
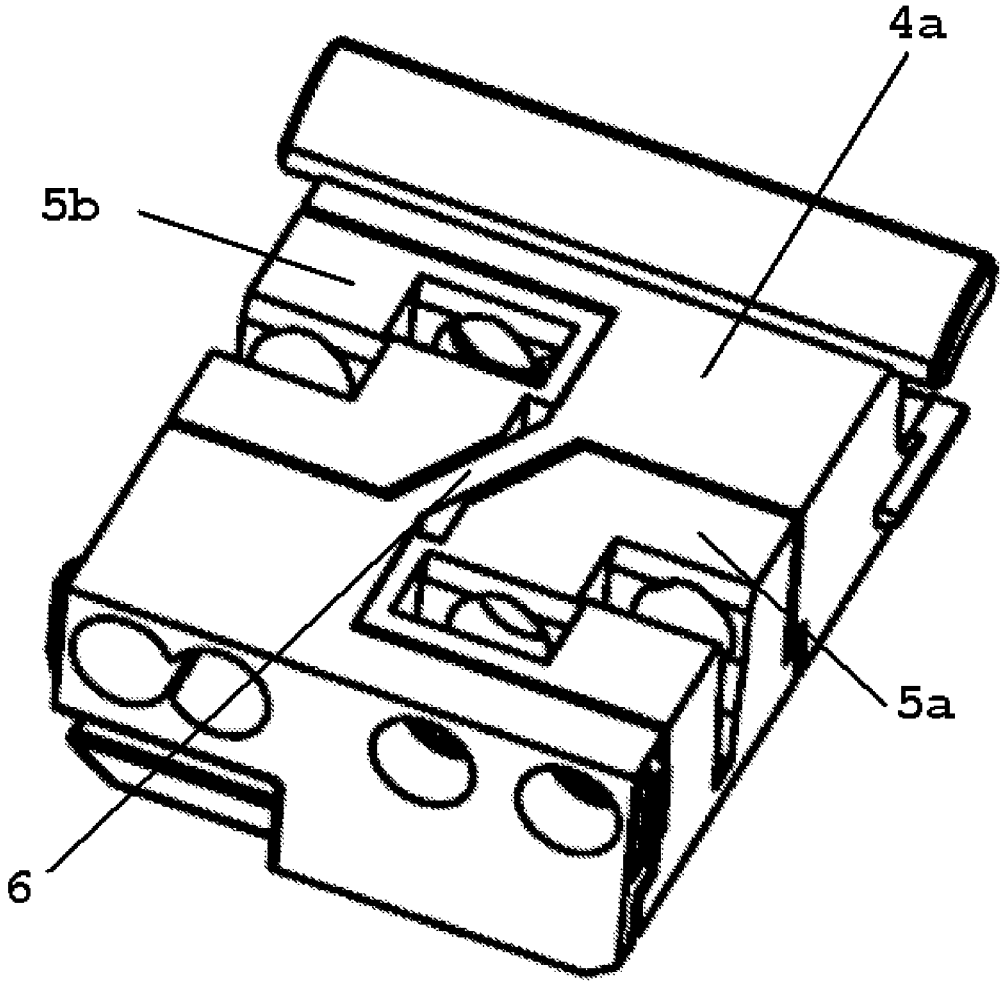
FIG. 3 shows a wiring flap and two associated inserts in the assembled state.
Figure 5:
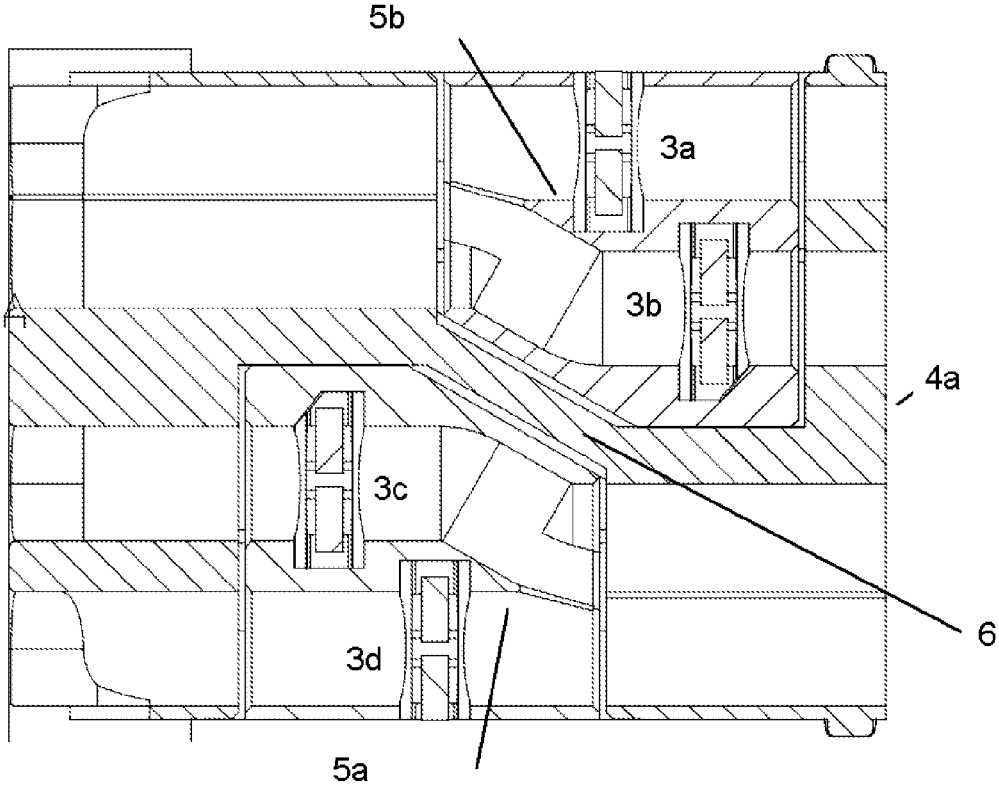
FIG. 5 shows a cross-sectional view of a wiring hinge and two associated inserts in the assembled state with clamping-cutting devices.

This electric bridge 6 shown in FIGS. 2, 3 and 5 separates the wires of a first pair of wires contacted through clamping-cutting devices 3*a* and 3*b* from the wires of a second pair of wires contacted through clamping-cutting devices 3*c* and 3*d*.

This further reduces near-end crosstalk between adjacent pairs of wires.

The plug-in connector 1 furthermore exhibits a base body 7, onto which wiring flaps 4*a*, 4*b* are hinged. The hinge joint of the wire flaps (4*a*, 4*b*) is located at the entry side of the wires, see FIG. 1.

The base body 7 can be made of plastic and may feature a metallic casing for better shielding against electromagnetic interference from the outside.

In the shown embodiment, wires that are part of a pair of wires are assigned to exactly one subset. This means that one pair of wires is routed either along the upper side or along the bottom side, however, due to possible near-end crosstalk it is not desired to attach one wire of a pair of wires to one damping-cutting device on the upper part, and the other wire of the pair of wires to a damping-cutting device on the lower part.

As already suggested, the wire flaps 4*a*, 4*b* may feature a conductive material. This means, that the wiring flaps 4*a*, 4*b* may be made of metal or molded out of an electrically conductive polymer. This provides shielding of the wires against each other as well as protection against electromagnetic interference from the outside.

Figure 4:
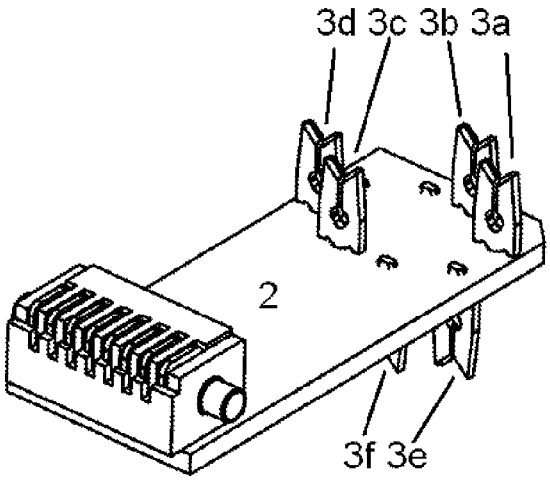
FIG. 4 shows two perspective views of a substrate with clamping-cutting devices.
Figure 4:
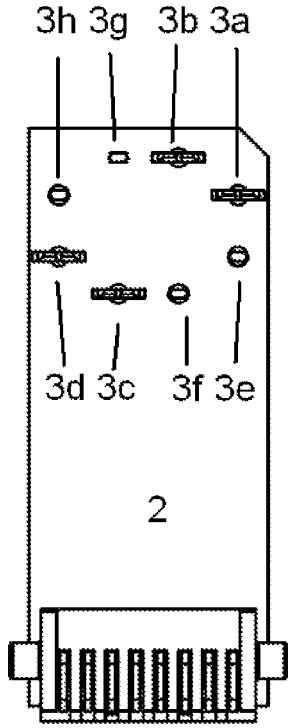

The clamping-cutting devices of the first subset 3*a*, 3*b*, 3*c*, 3*d* may also be configured on the substrate 2 offset to each other, so that wires, which are part of one pair of wires, are attached at a spatial distance from each other. This method can best be shown in connection with the perspective views in FIG. 4.

There it can be seen that the clamping-cutting devices are configured with only one clamping-cutting device in one plane per row and column. To illustrate this connection, see the following table.

TABLE 1

| | Column | | | |
|---|---|---|---|---|
| Row | 1 | 2 | 3 | 4 |
| 1 | | | 3b | |
| 2 | | | | 3a |

TABLE 1-continued

| | Column | | | |
|---|---|---|---|---|
| Row | 1 | 2 | 3 | 4 |
| 3 | 3d | | | |
| 4 | | 3c | | |

In this table, there is only one clamping-cutting device in each row and in each column.

The result is a greater distance between clamping-cutting devices within one pair of wires, e.g. 3*a* and 3*b*, as well as between the clamping-cutting devices of different wire pairs, e.g. clamping-cutting device 3*c* from a first pair of wires is remote from clamping-cutting device 3*b* from another pair of wires.

Plug-in connectors 1 according to the invention may be RJ45 plugs, which are typically used in network or telecommunications installations.

In particular the configuration of the clamping-cutting devices as well as the inclusion of the electrically conductive bridge 6 allows the provision of plug-in connectors 1 meeting the requirements of Cat6A.

By choosing clamping-cutting devices on the upper side as well as on the bottom side of a substrate 2, the cable-pulling forces are distributed across two sides of the substrate 2, and thus, in relation to one subset of clamping-cutting devices reduced, e.g. in the case of two subsets with the same number of clamping-cutting devices, they are cut in half. This design provides an appropriate strain relief as well as a particularly simple assembly of a strain relief.

Without further explanation, the substrate 2 may also contain balancing capacities, so that the high-frequency properties of the plug-in connector 1 can be adapted over a wide range.

The wiring flaps 4*a*, 4*b* may furthermore be designed such as to create an electrically conductive contact to the base body 7 or to an electrically conductive coating or an electrically conductive support on the base body 7, so that a shield around the entire clamping-cutting device area and the substrate all the way to the actual plug-in area, which may create contact to a matching jack, will be provided. This type of design further improves the RF performance.

What is claimed is:

1. A plug-in connector for the insertion of a multi-wire cable, wherein the wires are connected to the plug-in connector with a clamping-stripping technique, comprising:

a substrate, a plurality of clamping-stripping devices located on the substrate and suitable for the insertion of wires, wherein a first subset of the plurality of clamping-stripping devices is located on top of the substrate and a second subset of the plurality of clamping-stripping devices is located at the bottom of the substrate, and hinged wiring flaps that are configured to install wires into the clamping-stripping devices, wherein the wiring flaps include at least one electrically conductive bridge for high-frequency wire separation.

2. The plug-in connector according to claim 1 wherein the quantity of the first subset is identical to the quantity of the second subset.

3. The plug-in connector according to claim 1 wherein the wiring flaps comprise insulating inserts configured to install wires into the clamping-stripping devices.

4. The plug-in connector according to claim 1 further comprising a base body to which the wiring flaps are hinged, and wherein the hinge joint of the wiring flaps is located on the entry side of the wires.

5. The plug-in connector according to claim 1 wherein wires, which are part of a pair of wires, are assigned to exactly one subset.

6. The plug-in connector according to claim 1 wherein the wiring flaps are made from a conductive material.

7. The plug-in connector according to claim 1 wherein the clamping-stripping devices of the first subset are attached to the substrate at an offset, so that wires which are part of a pair of wires that are connected to the plug-in connector are attached at a spatial distance from each other.

8. The plug-in connector according to claim 1 wherein the connector is an RJ45 plug.

9. The plug-in connector according to claim 1 wherein the connector complies with the Cat6A standard.

* * * * *